US006421844B1

(12) United States Patent
Scott

(10) Patent No.: US 6,421,844 B1
(45) Date of Patent: Jul. 23, 2002

(54) TOILET FLUSHING APPARATUS

(76) Inventor: Jonathon L. Scott, 3400 W. Weaver Rd., Hampton, VA (US) 23666

( * ) Notice: Subject to any disclaimer, the term of this patent is extended or adjusted under 35 U.S.C. 154(b) by 0 days.

(21) Appl. No.: 10/014,206

(22) Filed: Nov. 9, 2001

(51) Int. Cl.[7] ..... E03D 1/14
(52) U.S. Cl. ..... 4/325; 4/405
(58) Field of Search ..... 4/324, 325, 326, 4/327, 408, 411–415

(56) References Cited

U.S. PATENT DOCUMENTS

| | | | | | |
|---|---|---|---|---|---|
| 1,992,381 | A | * | 2/1935 | Lyons | 4/324 |
| 3,719,957 | A | | 3/1973 | Riedel | |
| 3,745,591 | A | | 7/1973 | Girten | |
| 4,014,050 | A | * | 3/1977 | Goldsworthy | |
| 4,225,987 | A | * | 10/1980 | Goldman et al. | 4/324 |
| 4,356,576 | A | | 11/1982 | Gala | |
| 4,411,029 | A | * | 10/1983 | Huang | 4/324 |
| 4,750,220 | A | * | 6/1988 | Baumann | 4/324 |
| 4,864,665 | A | * | 9/1989 | Toltzman | 4/324 |
| 4,916,761 | A | | 4/1990 | Pavlik | |
| 5,375,268 | A | * | 12/1994 | Chen | 4/324 |
| 5,400,445 | A | * | 3/1995 | Hull | 4/405 |
| D360,932 | S | | 8/1995 | Walter et al. | |
| 5,680,659 | A | * | 10/1997 | Gessaman | |
| 5,708,990 | A | | 1/1998 | Mucciarone | |
| 6,311,342 | B1 | * | 11/2001 | Hwang | 4/325 |

* cited by examiner

*Primary Examiner*—Charles R. Eloshway

(57) ABSTRACT

A toilet flushing apparatus for using a portion of the water in the tank of the toilet for flushing light waste materials from the bowl of the toilet. The toilet flushing apparatus includes a bracket member being designed for coupling to an exterior surface of a tank of the toilet. A primary handle member is designed for coupling to the actuating arm of the trip lever. The primary handle member is pivotal with respect to the bracket member. The primary handle member is designed for flushing of the toilet when the primary handle member is pivoted. A secondary handle member is coupled to the bracket member. The secondary handle member pivots with respect to the bracket member. The secondary handle member abuts the primary handle member and pivots the primary handle member when the secondary handle member is pivoted by the hand of the user.

11 Claims, 2 Drawing Sheets

TOILET FLUSHING APPARATUS

BACKGROUND OF THE INVENTION

1. Field of the Invention

The present invention relates to flush control apparatus and more particularly pertains to a new toilet flushing apparatus for using a portion of the water in the tank of the toilet for flushing light waste materials from the bowl of the toilet.

2. Description of the Prior Art

The use of flush control apparatuses is known in the prior art. U.S. Pat. No. 4,356,576 describes a device/system for selecting an amount of water to be used to flush the toilet. Another type of flush control apparatus is U.S. Pat. No. 3,745,591 having a toilet flushing mechanism that is positioned the handle of the toilet for selectively controlling the amount of water used to flush the toilet. Another type of flush control apparatus is U.S. Pat. No. 5,708,990 having a water saving device that is positioned adjacent the handle of the toilet to permit the user to selectively release an amount of water in the tank to flush the toilet. Another type of flush control apparatus is U.S. Pat. No. 3,719,957 having a flush tank control that limits the movement of the handle of the toilet to control the amount of water being released from the tank to flush the toilet. Another type of flush control apparatus is U.S. Pat. No. 4,916,761 having a water saving device that is positioned of along the exterior of the tank such that the user fingers impact the device to alert the user to release the handle for metered release of water from the tank. Unlike the present invention, all the devices as described above requires one to move a portion of the flush control apparatus to allow the user to use the full amount of the water in the tank to allow for a full flush of the toilet. Also unlike the present invention U.S. Pat. No. Des. 360,932 has a controller that is to be mounted within the tank of the toilet to control the amount of water used to flush the toilet, Unlike the present invention.

While these devices fulfill their respective, particular objectives and requirements, the need remains for a device that has certain improved features that facilitate the selection of the amount of water to be used to flush the toilet by selecting an appropriate handle member. The selection of one handle member over the other permits intuitive selection without the need for manual manipulation to select between the desired amount of water to be released from the tank of the toilet.

SUMMARY OF THE INVENTION

The present invention meets the needs presented above by permitting supply a primary handle member and a secondary handle member coupled to the tank of the toilet. The primary handle is actuated by the user to permit the user to allow the full contents of the tank to be used to flush the toilet. The secondary handle member is actuated by the user and contacts the primary handle allowing for a limited actuation of the primary handle to allow a limited amount of water to be used to flush the toilet.

Still yet another object of the present invention is to provide a new toilet flushing apparatus that permits a pre determined amount of water to be used to flush urine and light waste materials in a toilet.

To this end, the present invention generally comprises a bracket member being designed for coupling to an exterior surface of a tank of the toilet. The bracket member is designed for being positioned adjacent an actuating arm of a trip lever of the toilet. A primary handle member is designed for coupling to the actuating arm of the trip lever. The primary handle member is pivotal with respect to the bracket member. The primary handle member is designed for being pivoted by a hand of a user. The primary handle member is designed for flushing of the toilet when the primary handle member is pivoted. A secondary handle member is coupled to the bracket member. The secondary handle member pivots with respect to the bracket member. The secondary handle member abuts the primary handle member and pivots the primary handle member when the secondary handle member is pivoted by the hand of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
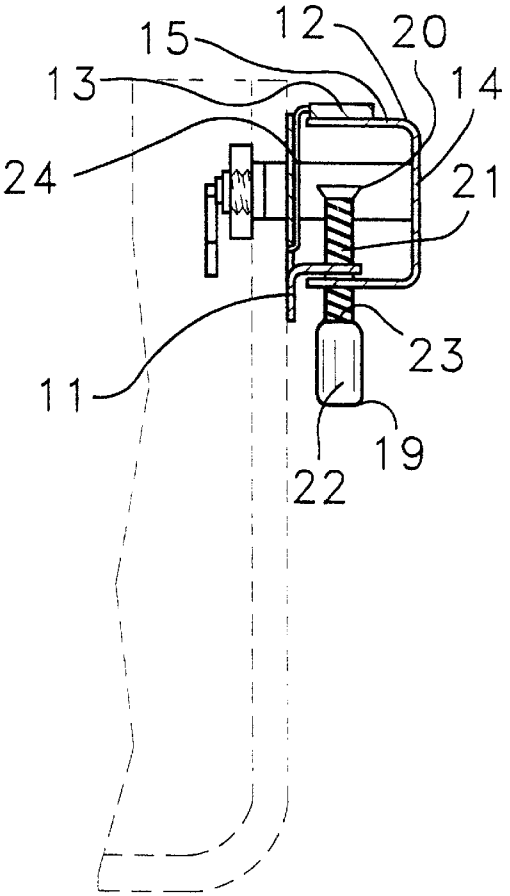
FIG. 2 is a cross-sectional view of the present invention.
Figure 1:
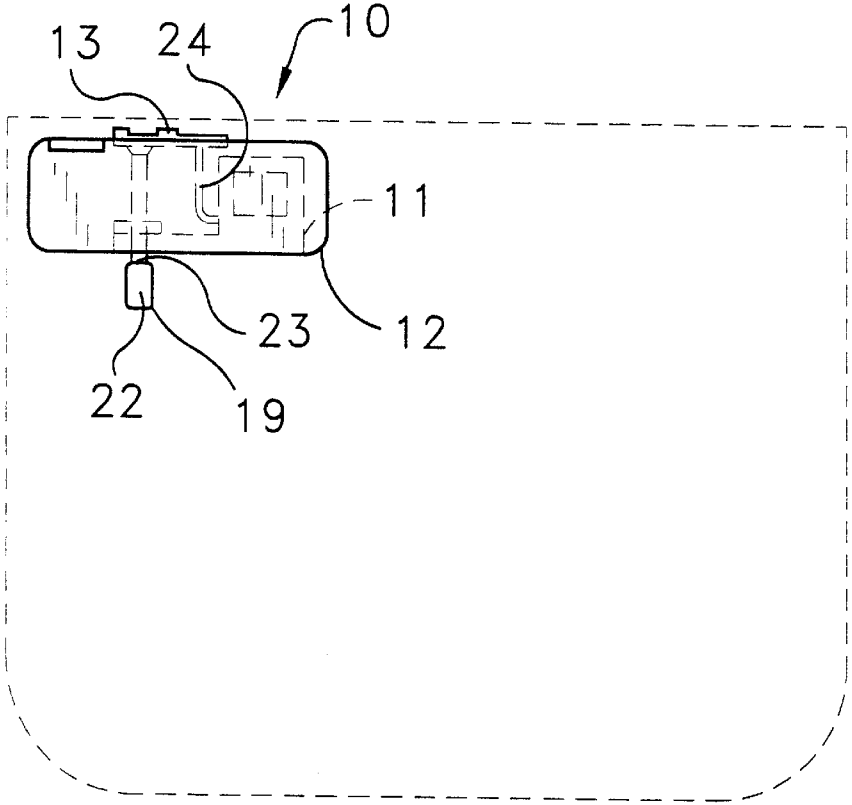
FIG. 1 is a front view of a new toilet flushing apparatus according to the present invention.
Figure 3:
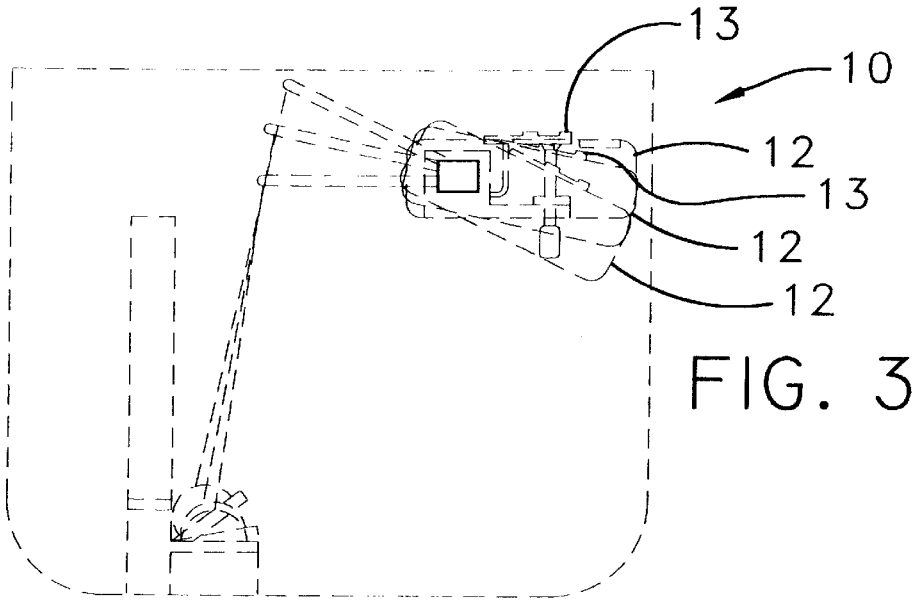
FIG. 3 is a rear view of the present invention showing of the different positions of the primary handle member and secondary handle member.
Figure 4:
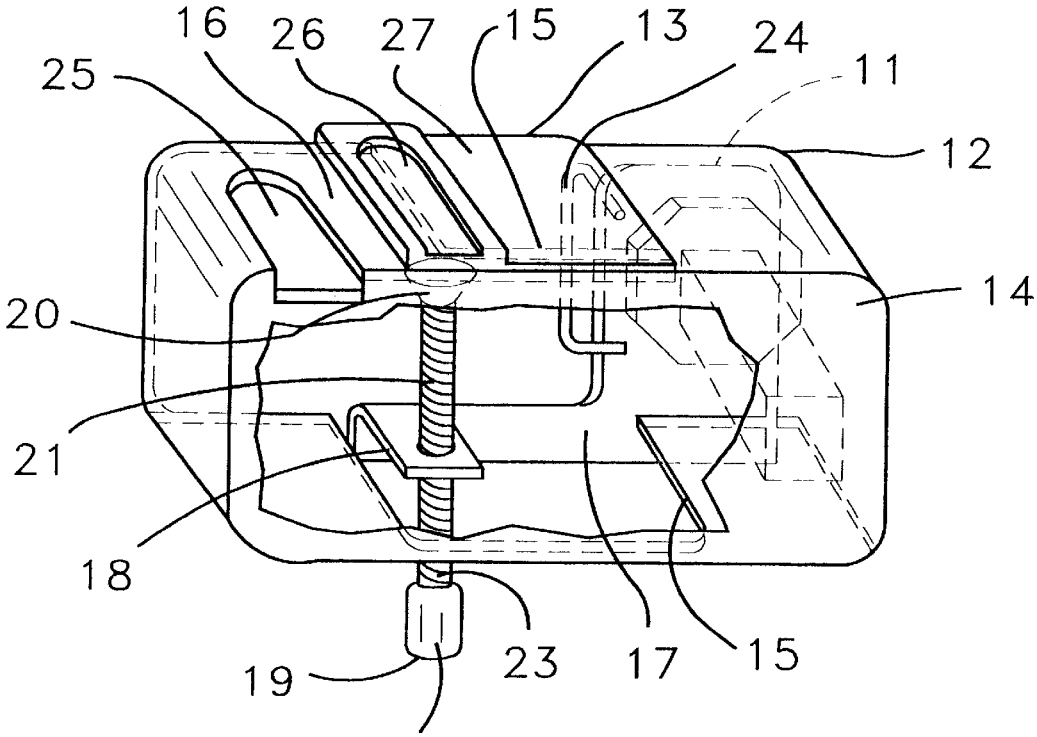
FIG. 4 is a perspective partial cross-sectional view of the present invention.

With reference now to the drawings, and in particular to FIGS. 1 through 4 thereof, a new toilet flushing apparatus embodying the principles and concepts of the present invention and generally designated by the reference numeral 10 will be described.

As best illustrated in FIGS. 1 through 4, the toilet flushing apparatus 10 generally comprises a bracket member 11 being designed for coupling to an exterior surface of a tank of the toilet. The bracket member 11 is designed for being positioned adjacent an actuating arm of a trip lever of the toilet.

A primary handle member 12 is designed for coupling to the actuating arm of the trip lever. The primary handle member 12 is pivotal with respect to the bracket member 11. The primary handle member 12 is designed for being pivoted by a hand of a user. The primary handle member 12 is designed for flushing of the toilet when the primary handle member 12 is pivoted.

A secondary handle member 13 is coupled to the bracket member 11. The secondary handle member 13 pivots with respect to the bracket member 11. The secondary handle member 13 abuts the primary handle member 12 and pivots the primary handle member 12 when the secondary handle member 13 is pivoted by the hand of the user.

The primary handle member 12 has a perimeter wall 14. The perimeter wall 14 of the primary handle member 12 has a pair access cutouts 15. Each of the access cutouts 15 permits the primary handle member 12 to be pivoted without contacting the bracket member 11 for permitting full flushing of the toilet.

The secondary handle member 13 is positioned over one of the access cutouts 15 in an upper wall 16 of the perimeter wall 14 of the primary handle member 12. The secondary handle member 13 is for engaging the bracket member 11 when the secondary handle member 13 is pivoted for selectively partially flushing the toilet.

The bracket member 11 has a base portion 17. The base portion 17 is designed for abutting the exterior surface of the tank of the toilet. The bracket member 11 has a flange portion 18. The flange portion 18 outwardly extends from the base portion 17 of the bracket portion. The flange portion 18 is for selectively engaging the secondary handle member 13 when the secondary handle is pivoted for selectively partially flushing the toilet.

An adjustment member 19 is selectively coupled to the flange portion 18 of the bracket member 11. A length between a distal end 20 of the adjustment member 19 and the flange portion 18 is adjustable for metering the amount of water used to flush the toilet when the secondary handle member 13 is pivoted. The adjustment member 19 has a shaft portion 21. The shaft portion 21 of the adjustment member 19 threadably extends through the flange portion 18 of the bracket portion whereby rotation of the adjustment member 19 adjusts the length between the distal end 20 of the adjustment member 19 and the flange portion 18 of the bracket.

The adjustment member 19 has a knob 22. The knob 22 is coupled to a free end 23 of the adjustment member 19 opposite the distal end 20 of the adjustment member 19. The knob 22 of the adjustment member 19 is designed for permitting adjustment of the length between the distal end 20 of the adjustment member 19 and the flange portion 18 of the bracket member 11.

A biasing member 24 is coupled between the secondary handle member 13 and the bracket member 11. The biasing member 24 is for biasing the secondary handle member 13 away from the bracket member 11 when the secondary handle member 13 is released by the user.

The primary handle member 12 has a primary depression 25. The primary depression 25 is positioned in the upper wall 16 of the primary handle member 12. The primary depression 25 permits the user to readily identify the primary handle member 12 without visual identification of the primary handle member 12 when the user wishes to use the entire contents of the tank of the toilet to flush the toilet. The secondary handle member 13 has a secondary depression 26. The primary depression 25 is positioned in an upper surface 27 of the secondary handle member 13. The secondary depression 26 permits the user to readily identify the secondary handle member 13 without visual identification of the secondary handle member 13 when the user wishes to use a portion of the contents of the tank of the toilet to flush the toilet.

In use, the user couples the bracket member 11 to the exterior surface of the tank proximate the actuating arm of the trip lever. The secondary handle member 13 being coupled to the bracket member 11 is like wise positioned proximate the actuating arm of the trip lever. The primary handle member 12 is then coupled to the actuating arm of the tip lever whereby the flange portion 18 and adjustment member 19 are positioned to pass through the access cutouts 15 of primary handle member 12. The secondary handle is positioned over the top wall of the primary handle member 12 and one of the access cutouts 15. The adjustment member 19 is then adjusted to allow only a portion of the water in the tank to be used to flush the toilet. The user then presses on the secondary handle member 13 which pivots the trip lever a short distance for allowing the tank ball to be opened a small distance to allow a portion of the water in the rank to escape to flush the toilet when the secondary handle member 13 contacts the adjustment member 19 to flush urine or light waste material, such as tissue paper, from the toilet. The user can if desired depress the primary handle member 12, which will pivot father than the secondary handle will, to use the entire contents of the tank to flush the toilet.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet flushing apparatus for metering the amount of water used to flush a toilet, the toilet flushing apparatus comprising:

a bracket member being adapted to be positioned entirely on an exterior surface of a tank of the toilet, said bracket member being adapted for being positioned adjacent an actuating arm of a trip lever of the toilet;

a primary handle member being adapted for coupling to the actuating arm of the trip lever, said primary handle member being pivotal with respect to said bracket member such that said primary handle member is adapted for being pivoted by a hand of a user, said primary handle member being adapted for flushing of the toilet when said primary handle member is pivoted; and a secondary handle member independent of said primary handle member and being pivotally coupled to said bracket member, said secondary handle member abutting said primary handle member and pivoting said primary handle member without contacting said actuating arm when said secondary handle member is pivoted by the hand of the user.

2. The toilet flushing apparatus as set forth in claim 1, further comprising:

said primary handle member having a perimeter wall, said perimeter wall of said primary handle member having a pair access cutouts, each of said access cutouts permitting said primary handle member to be pivoted without contacting said bracket member for permitting full flushing of the toilet.

3. The toilet flushing apparatus as set forth in claim 2, further comprising:

said secondary handle member being positioned over one of said access cutouts in an upper wall of said perimeter wall of said primary handle member, said secondary handle member being for engaging said bracket member when said secondary handle member is pivoted for selectively partially flushing the toilet.

4. The toilet flushing apparatus as set forth in claim 1, further comprising:

said bracket member having a base portion, said base portion being adapted for abutting the exterior surface of the tank of the toilet; and said bracket member having a flange portion, said flange portion outwardly extending from said base portion of said bracket portion, said flange portion having means for selectively engaging said secondary handle member when said secondary handle is pivoted for selectively partially flushing the toilet.

5. The toilet flushing apparatus as set forth in claim 4, wherein said means for selectively engaging said secondary handle member further comprising:

an adjustment member being selectively coupled to said flange portion of said bracket member, a length between a distal end of said adjustment member and said flange portion being adjustable for metering the amount of water used to flush the toilet when said secondary handle member is pivoted.

6. The toilet flushing apparatus as set forth in claim 5, further comprising:

said adjustment member having a shaft portion, said shaft portion of said adjustment member being threadably extending through said flange portion of said bracket portion such that rotation of said adjustment member adjusts the length between said distal end of said adjustment member and said flange portion of said bracket.

7. The toilet flushing apparatus as set forth in claim 5, further comprising:

said adjustment member having a knob, said knob being coupled to a free end of said adjustment member opposite said distal end of said adjustment member, said knob of said adjustment member being adapted for permitting adjustment of the length between said distal end of said adjustment member and said flange portion of said bracket member.

8. The toilet flushing apparatus as set forth in claim 1, further comprising:

a biasing member being coupled between said secondary handle member and said bracket member, said biasing member being for biasing said secondary handle member away from said bracket member when said secondary handle member is released by the user.

9. The toilet flushing apparatus as set forth in claim 1, further comprising:

said primary handle member having a primary depression, said primary depression being positioned in an upper wall of said primary handle member, said primary depression permitting the user to readily identify said primary handle member without visual identification of said primary handle member when the user wishes to use the entire contents of the tank of the toilet to flush the toilet.

10. The toilet flushing apparatus as set forth in claim 9, further comprising:

said secondary handle member having a secondary depression, said primary depression being positioned in an upper surface of said secondary handle member, said secondary depression permitting the user to readily identify said secondary handle member without visual identification of said secondary handle member when the user wishes to use a portion of the contents of the tank of the toilet to flush the toilet.

11. A toilet flushing apparatus for metering the amount of water used to flush a toilet, the toilet flushing apparatus comprising:

a bracket member being adapted for coupling to an exterior surface of a tank of the toilet, said bracket member being adapted for being positioned adjacent an actuating arm of a trip lever of the toilet;

a primary handle member being adapted for coupling to the actuating arm of the trip lever, said primary handle member being pivotal with respect to said bracket member such that said primary handle member is adapted for being pivoted by a hand of a user, said primary handle member being adapted for flushing of the toilet when said primary handle member is pivoted;

a secondary handle member being coupled to said bracket member, said secondary handle member pivoting with respect to said bracket member, said secondary handle member abutting said primary handle member and pivots said primary handle member when said secondary handle member is pivoted by the hand of the user;

said primary handle member having a perimeter wall, said perimeter wall of said primary handle member having a pair access cutouts, each of said access cutouts permitting said primary handle member to be pivoted without contacting said bracket member for permitting full flushing of the toilet;

said secondary handle member being positioned over one of said access cutouts in an upper wall of said perimeter wall of said primary handle member, said secondary handle member being for engaging said bracket member when said secondary handle member is pivoted for selectively partially flushing the toilet;

said bracket member having a base portion, said base portion being adapted for abutting the exterior surface of the tank of the toilet;

said bracket member having a flange portion, said flange portion outwardly extending from said base portion of said bracket portion, said flange portion having an adjustment member for selectively engaging said secondary handle member when said secondary handle is pivoted for selectively partially flushing the toilet;

said adjustment member being selectively coupled to said flange portion of said bracket member, a length between a distal end of said adjustment member and said flange portion being adjustable for metering the amount of water used to flush the toilet when said secondary handle member is pivoted;

said adjustment member having a shaft portion, said shaft portion of said adjustment member being threadably extending through said flange portion of said bracket portion such that rotation of said adjustment member adjusts the length between said distal end of said adjustment member and said flange portion of said bracket;

said adjustment member having a knob, said knob being coupled to a free end of said adjustment member opposite said distal end of said adjustment member, said knob of said adjustment member being adapted for permitting adjustment of the length between said distal end of said adjustment member and said flange portion of said bracket member;

a biasing member being coupled between said secondary handle member and said bracket member, said biasing member being for biasing said secondary handle member away from said bracket member when said secondary handle member is released by the user;

said primary handle member having a primary depression, said primary depression being positioned in said upper wall of said primary handle member, said primary depression permitting the user to readily identify said primary handle member without visual identification of said primary handle member when the user wishes to use the entire contents of the tank of the toilet to flush the toilet; and said secondary handle member having a secondary depression, said primary depression being positioned in an upper surface of said secondary handle member, said secondary depression permitting the user to readily identify said secondary handle member without visual identification of said secondary handle member when the user wishes to use a portion of the contents of the tank of the toilet to flush the toilet.

* * * * *